US008684483B2

(12) United States Patent
Grace et al.

(10) Patent No.: US 8,684,483 B2
(45) Date of Patent: Apr. 1, 2014

(54) DROP FORMATION WITH REDUCED STIMULATION CROSSTALK

(75) Inventors: Jeremy M. Grace, Penfield, NY (US); Ronald L. Oyer, Hilton, NY (US); Giuseppe Farruggia, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 128 days.

(21) Appl. No.: 13/417,569

(22) Filed: Mar. 12, 2012

(65) Prior Publication Data

US 2013/0235102 A1 Sep. 12, 2013

(51) Int. Cl.

| | |
|---|---|
| ***B41J 29/38*** | (2006.01) |
| ***B41J 2/02*** | (2006.01) |
| ***B41J 2/085*** | (2006.01) |

(52) U.S. Cl.

USPC ..... 347/10; 347/9; 347/73; 347/76

(58) Field of Classification Search

USPC ..... 347/9, 10, 73–83

See application file for complete search history.

(56) References Cited

U.S. PATENT DOCUMENTS

| | | | | |
|---|---|---|---|---|
| 4,636,808 | A | 1/1987 | Herron | |
| 6,079,821 | A | 6/2000 | Chwalek et al. | |
| 6,450,628 | B1 * | 9/2002 | Jeanmaire et al. | 347/75 |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 * | 9/2004 | Jeanmaire | 347/74 |
| 6,827,429 | B2 | 12/2004 | Jeanmaire et al. | |
| 6,851,796 | B2 | 2/2005 | Jeanmaire et al. | |
| 7,777,395 | B2 | 8/2010 | Xu et al. | |
| 8,091,991 | B2 | 1/2012 | Hanchak et al. | |
| 2002/0085071 | A1 | 7/2002 | Jeanmaire et al. | |
| 2011/0109677 | A1 | 5/2011 | Montz et al. | |

OTHER PUBLICATIONS

Lord Rayleigh, "On the Instability of Jets," *Proc. London Math.* Soc. X (1878).

* cited by examiner

*Primary Examiner* — Jason Uhlenhake
(74) *Attorney, Agent, or Firm* — William R. Zimmerli

(57) ABSTRACT

A liquid stream is caused to jet from a nozzle. A small or large drop waveform applied to a drop forming mechanism causes the liquid stream to break up into a small or large volume drop, respectively. The small drop waveform includes a pulse having a width $w_S$, and a period x, where $x \approx 1/f_R$, where $f_R$ is the Rayleigh frequency of the liquid. The large drop waveform includes a period Nx, with the large volume drop being N times the small volume drop. The large drop waveform includes a first pulse having a pulse width $w_{L1}$, where $w_{L1} \geq w_S$, and a second pulse occurring within a period of $(f_R/f_C)x$ of an initial pulse of a subsequent small or large drop waveform, where $f_C$ is the cut off frequency of the liquid. The second pulse includes a pulse width $w_{L2}$, where $w_{L2} < w_S$.

6 Claims, 8 Drawing Sheets

DROP FORMATION WITH REDUCED STIMULATION CROSSTALK

CROSS REFERENCE TO RELATED APPLICATIONS

Reference is made to commonly-assigned, U.S. patent application Ser. No. 13/417,577, entitled "DROP FORMATION WITH REDUCED STIMULATION CROSSTALK", filed concurrently herewith.

FIELD OF THE INVENTION

This invention relates generally to the field of digitally controlled printing devices, and in particular to continuous printing systems in which a liquid stream breaks into drops that are deflected by a gas flow.

BACKGROUND OF THE INVENTION

In thermally stimulated continuous inkjet printing, see, for example, U.S. Pat. No. 6,588,888 B2, issued to Jeanmaire et al., on Jul. 8, 2003; and U.S. Pat. No. 6,079,821, issued to Chwalek et al., on Jun. 27, 2000, periodic heat pulses are applied to individual heaters embedded in a nozzle array. The periodic heat pulses drive capillary break-up of jets formed at each nozzle to produce an array of drops. The period of the pulse waveform determines the ultimate size of drop formed after jet break-up. Because the jet responds most sensitively to disturbances at a characteristic frequency $f_R$ known as the Rayleigh frequency, drops are most effectively produced at a fundamental size corresponding to a volume of fluid given by $\pi^2 U/f_R$, where r is the jet radius and U is the jet velocity.

U.S. Pat. No. 6,851,796 B2, issued to Jeanmaire et al., on Feb. 8, 2005, describes a printing system that relies on the ability to generate distinct sizes of drop—a "print drop" of a given size, and a "catch drop" of distinctly different size. Differential deflection of the drops of different sizes is employed to cause print drops to impinge on the substrate and the catch drops to be collected and recirculated through the ink delivery system. As described in U.S. Pat. No. 6,851,796 B2, an ink drop forming mechanism selectively creates a stream of ink drops having a plurality of different volumes traveling along a first path. A gas flow directed across the stream of ink drops interacts with the stream of ink drops. This interaction deflects smaller drops more than larger drops and thereby separates ink drops having one volume from ink drops having other volumes.

As the drop selection mechanism described above depends on drop size, it is necessary for large-volume drops to be fully formed before being exposed to the deflection air flow. Consider, for example, a case where the large-volume drop is to have a volume equal to four small-volume drops. It is often seen during drop formation that the portion of the ink stream that is to form the large-volume drop will separate from the main stream as desired, but will then break apart before coalescing to form the large-volume drop. It is necessary for this coalescence to be complete prior to passing through the drop deflecting air flow. Otherwise the separate fragments that are to form the large-volume drop will be deflected by an amount greater than that of a single large-volume drop. Similarly, the small-volume drops must not merge in air before having past the deflection air flow. If separate small-volume drops merge, they will be deflected less than desired.

The distance over which the large volume drop forms upon coalescence of its fragments is known as the drop formation length (DFL), denoted herein as $L_D$. The details of the large drop waveform and the physical properties of the jet determine the size of $L_D$. For the purposes of printing, smaller drop formation lengths are advantageous, as the drops are then available for size separation at distances closer to the nozzle plate, and the distance over which the drops must travel prior to separation is reduced. Thus a smaller drop formation length helps reduce the size of the print head and reduces the risk of incomplete large drop formation and reduces the risk of unintended merging of small drops.

It has been found that the small-volume drops between coalesced large-volume drops can be very unevenly spaced. In extreme circumstances, the large-volume drop often remains only partially formed until the large-volume drop is well beyond the deflection air flow. The partially formed large-volume drop and the small-volume drop immediately in front of it must merge to produce the completed large-volume drop. Occasionally, an undesirable merging of a small-volume drop and a large-volume drop will occur at some distance from the orifices. It is desirable to have the merging drops coalesce as quickly as possible after break off without additional merging of the small-volume drops with large-volume drops or with adjacent small-volume drops.

Continuous drop emission systems that utilize stimulation per jet apparatus are effective in providing control of the break-up parameters of an individual jet within a large array of jets. As described in U.S. Pat. No. 7,777,395 B2, issued to Xu et al., on Aug. 17, 2010, however, even when the stimulation is highly localized to each jet, for example, via resistive heating at the nozzle exit of each jet, some stimulation crosstalk still propagates as acoustic energy through the liquid via the common supply chambers. The added acoustic stimulation crosstalk from adjacent jets may adversely affect jet break up in terms of break-off timing or satellite drop formation. When operating in a printing mode of generating different predetermined drop volumes, according to the liquid pattern data, acoustic stimulation crosstalk may alter the jet break-up producing drops that are not the desired predetermined volume. Especially in the case of systems using multiple predetermined drop volumes, the effects of acoustic stimulation crosstalk are data-dependent, leading to complex interactions that are difficult to predict.

Stimulation crosstalk can manifest itself in a pattern along an entire nozzle array, suggestive of acoustic modes in portions of the printhead behind the nozzle array. In addition to the long-range effects including, for example, over hundreds to thousands of nozzles and macroscopic distances, there are short-range effects in which stimulation of a given jet affects neighboring jets. Of particular importance is the effect of producing a large drop in one jet while making small drops in neighboring jets. The disturbance resulting from the large drop waveform can impart differential velocity to small drops in a neighboring jet, thereby causing unintended merging of small drops. The degree of disturbance in neighboring jets caused by a large-drop waveform is sensitive to the details of the large-drop waveform. Large-drop waveforms wherein the heat pulses minimally disturb the neighboring jets concurrently operating during printing are advantageous, as high-quality prints are more readily achieved with simple and robust data processing algorithms requiring less compensation for particular patterns of drop formation in neighboring jets.

Thus, there is a need for waveforms for making large drops that provides a short drop formation length with reduced disturbance of neighboring jets.

SUMMARY OF THE INVENTION

According to an aspect of the invention, a method of operating a jetting module includes providing a jetting module including a nozzle and a drop forming mechanism. Liquid is provided to the jetting module under pressure sufficient to cause a liquid stream to jet from the nozzle. A small drop waveform is provided that causes the liquid stream to break up into a small volume drop. The small drop waveform includes a pulse having a width $w_S$, and a period x, where $x \approx 1/f_R$, where $f_R$ is the Rayleigh frequency of the liquid. A large drop waveform is provided that causes the liquid stream to break up to form a large volume drop. The large drop waveform includes a period Nx, with the large volume drop being N times the volume of the small volume drop. The large drop waveform including a first pulse having a pulse width $w_{L1}$, where $w_{L1} \geq w_S$, the large drop waveform includes a second pulse occurring within a period of $(f_R/f_C)x$ of an initial pulse of a subsequent small drop waveform or a subsequent large drop waveform, where $f_C$ is the cut off frequency of the liquid. The second pulse includes a pulse width $w_{L2}$, where $w_{L2} < w_S$. The drop forming mechanism is activated using a sequence of small drop waveforms, the large drop waveforms, or combinations thereof.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
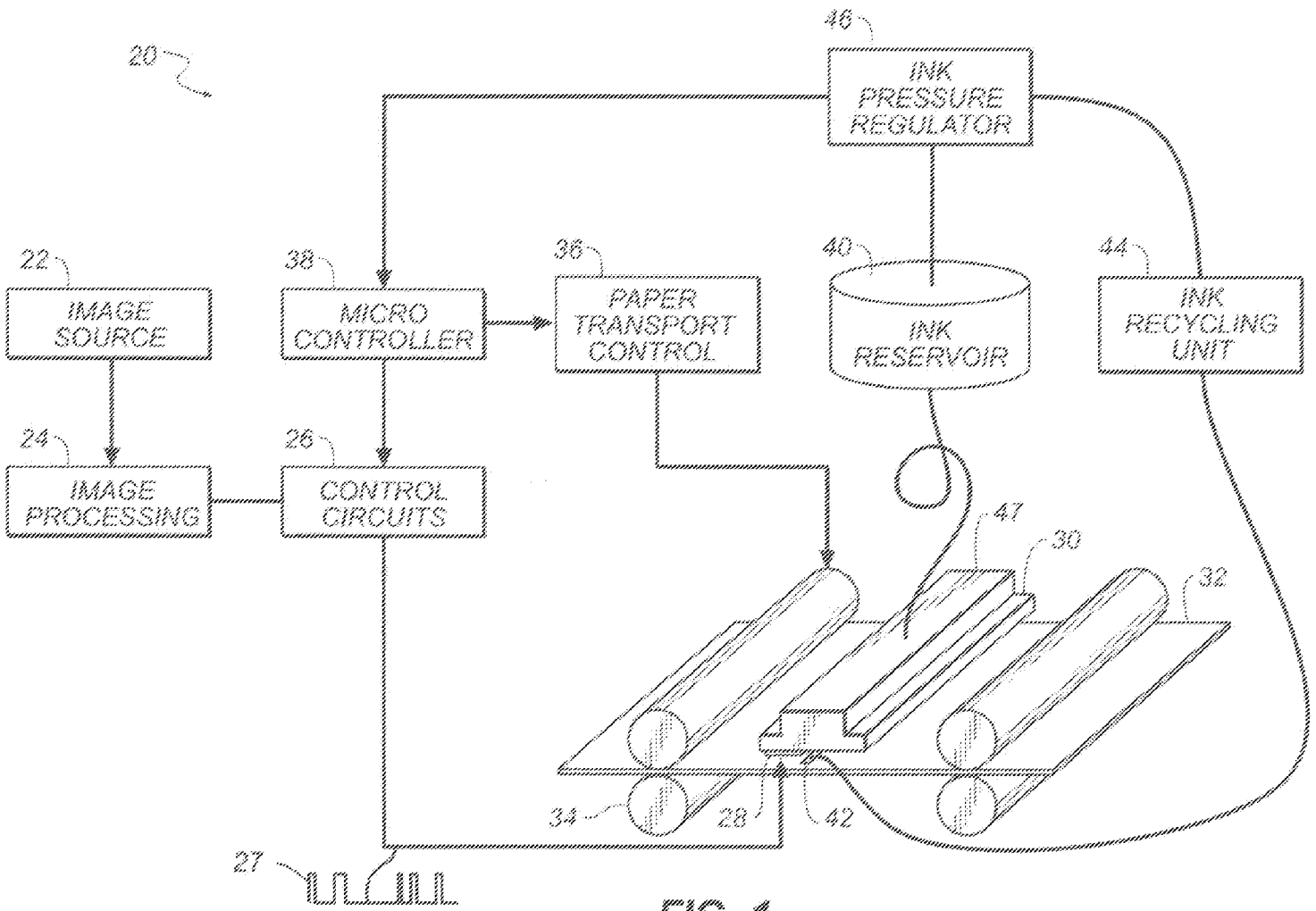
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
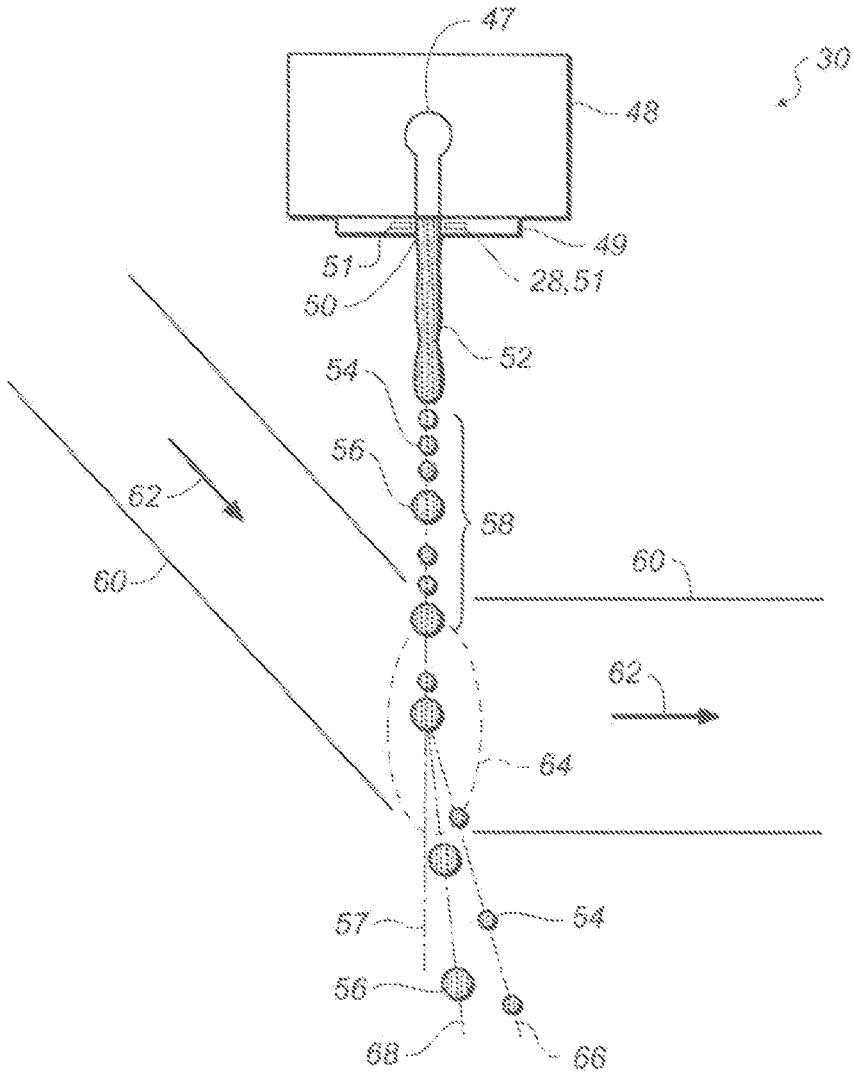
FIG. 2 is a schematic view of an example embodiment of a continuous printhead made in accordance with the present invention.
Figure 3:
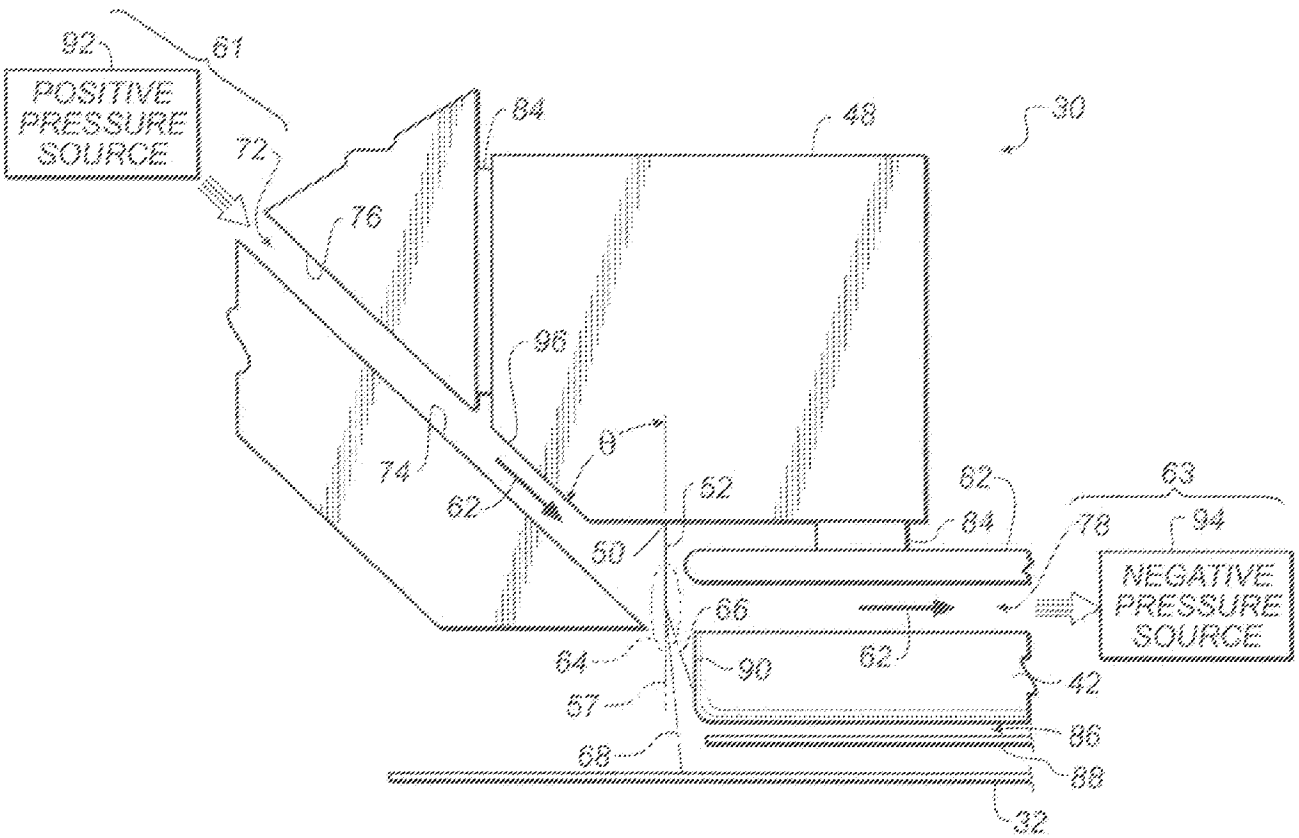
FIG. 3 is a schematic view of an example embodiment of a continuous printhead made in accordance with the present invention.

Referring to FIG. 1 and FIGS. 2 and 3, example embodiments of a printing system and a continuous printhead are shown that include the present invention described below. It is contemplated that the present invention also finds application in other types of printheads or jetting modules including, for example, drop on demand printheads and other types of continuous printheads.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply drop formation waveforms 27, typically a sequence of time-varying electrical pulses, to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation device 28, also commonly called a drop forming device, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. The selective activation of the drop forming device 28 occurs in response to drop formation waveforms received from control circuits 26. The control circuits typically create a sequence of drop formation waveforms based on the dot pattern to be printed. The sequence of waveforms consists of one or more waveforms for the creation of small drops and one or more waveforms for the creation of large drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle $\theta$ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and either can be used usually the selection depending on the application contemplated. Alternatively, catcher 42 can be of any suitable design including, but not limited to, a porous face catcher, a delimited edge catcher, or combinations of any of those described above.

By way of background, ink supplied to the drop generator passes through the nozzles of the orifice plate, forming a cylindrical filament or jet of fluid having a diameter, D, which is approximately the diameter of the nozzle. This jet of fluid moves at a velocity $V_J$. When the pulses are applied to the stimulation device, for example, a heater surrounding a nozzle, a perturbation is created in the diameter of the jet at the nozzle. This perturbation moves with the fluid. The perturbation therefore moves at the velocity, $V_J$. If another pulse is applied to the stimulation device, another perturbation is created in the diameter of the jet at the nozzle that also moves with the jet at $V_J$. It is well known that if the spacing of the perturbations on the jet is greater than Rayleigh limit $\lambda_C$, which is approximately $\pi$*D, the amplitude of the perturbation can grow (see generally, Lord Rayleigh, "On the Instability of Jets," *Proc. London Math.* Soc. X (1878)). As the perturbation grows, eventually it will grow to the point that it will cause a drop to separate from the jet. On the other hand, if the spacing is less than the Rayleigh limit $\lambda_C$, the amplitude of the perturbation will shrink, and it will not cause a drop to break off from the jet. Lord Rayleigh's studies also showed that there is a spacing between perturbations $\lambda_R$ at which the perturbation amplitude grows most rapidly. For many common fluids to be jetted from a nozzle, $\lambda_R$ is approximately 4.5*D. The existence of a cutoff spacing between perturbations $\lambda_C$ implies that there is cutoff time period $X_C$ between consecutive pulses to the drop formation device 28 below which the perturbations produced on the liquid jet by the drop formation device will shrink, and above which the perturbations will grow. Equivalently there is a cutoff frequency $f_C$ above which perturbations produced on the liquid jet by the drop formation device will shrink, and below which the perturbations will grow. For fluids at low Weber number, where the simple Rayleigh theory applies, $fc=V_j/(2\pi R)$, where $V_j$ is the jet velocity and R is the jet radius. Furthermore, the existence of a perturbation spacing $\lambda_R$ at which the perturbations grow most rapidly indicates that there is a perturbation period $X_R$ and a corresponding perturbation frequency $f_R$, referred to herein as the Rayleigh period and Rayleigh frequency respectively, at which the resulting perturbations grow most rapidly. The growth rate for perturbations falls off fairly quickly at perturbations periods less than the Rayleigh period, falling off most rapidly just above the cutoff period. The steep slope of the perturbation growth rate curve just above the cutoff period causes the stimulation to be very sensitive to small changes in hole size, jet velocity, or ink properties in this region. As the perturbation growth rate curve is maximized at the Rayleigh period, the slope of the perturbation growth rate curve near the Rayleigh period is near zero causing the stimulation to be very insensitive to small changes in hole size, jet velocity, or ink properties near this perturbation period.

Figure 4:
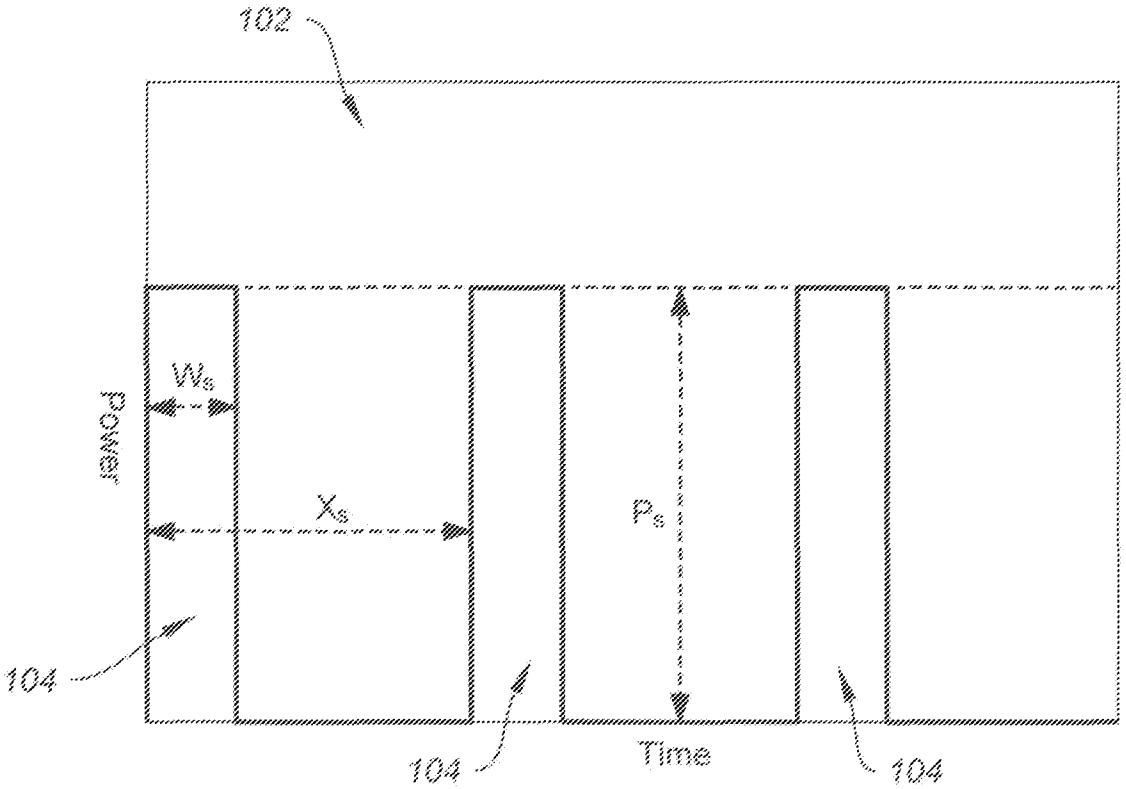
FIG. 4 is a schematic representation of a small drop waveform made in accordance with the present invention.

A sequence of three small drop waveforms 102 is shown in FIG. 4. The small-drop waveform 102 has a period $X_S$ and includes a voltage pulse or, more generally, an energy pulse 104 having energy $E_S$. The energy pulse typically comprises a voltage or a current pulse applied to the drop formation device by the control circuits 26. The drop formation device 28, when supplied with a small drop waveform 102 produces a perturbation or disturbance on the filaments of liquid 52 having time period of $X_S$. As the filament of liquid, also called a liquid jet, leaves the nozzle at a jet velocity $V_J$, the perturbation, having a time period of $X_S$ has a spatial period on the liquid jet or $\lambda_S=X_S*V_J$. The period $X_S$ is generally chosen to be approximately equal to the Rayleigh period $X_R$. The Rayleigh period is equal to the inverse of the Raleigh frequency; $X_R=1/f_R$. This yields the maximum growth rate for a disturbance in a capillary jet, and makes the stimulation least sensitive to small changes in nozzle diameter, jet velocity, which is affected by the ink pressure, and fluid properties such as surface tension, viscosity, density, and radius. The perturbation amplitude then grows exponentially until it causes a segment of the liquid jet to break off to form a drop. The volume of the drop equals that of a $\lambda_S$ long segment of the liquid jet. The voltage or stimulation level applied during pulse 104 corresponds to a dc power level $P_S$, and the energy $E_S$ of the pulse having a width $w_S$ is given by $E_S=P_S \cdot w_S$.

Figure 5B:
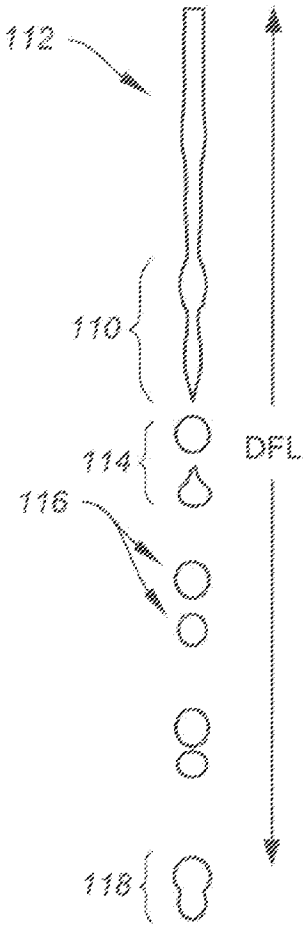
FIG. 5B is a schematic representation of drops formed using the waveform shown in FIG. 5A.
Figure 5A:
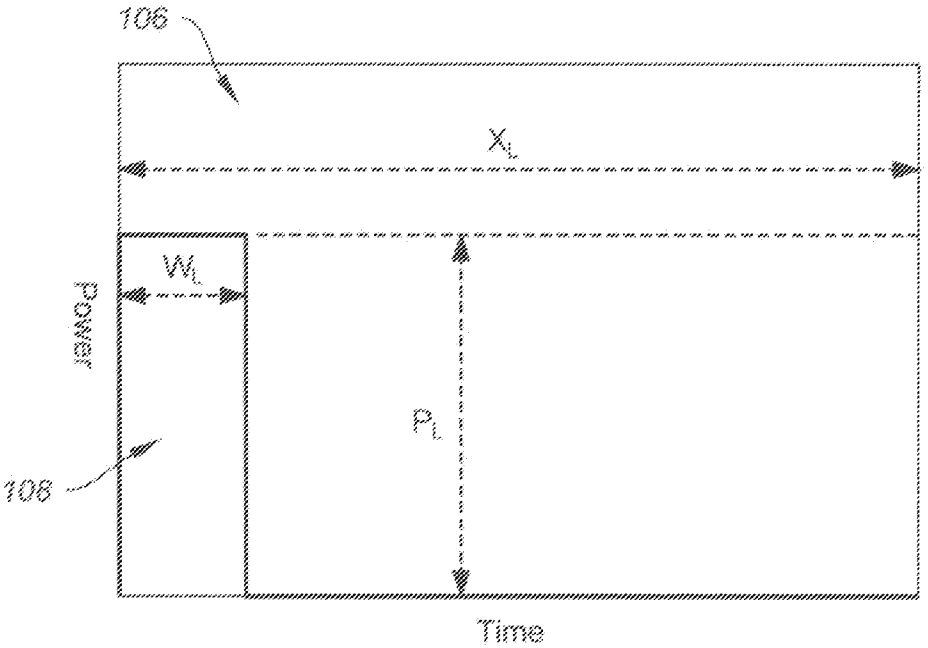
FIG. 5A is a schematic representation of a conventional large drop waveform.

In the present invention, various pulses are described for the creation of the large and small drops. It is recognized that these individual pulses for the creation of the drops can be formed as a burst of pulses generated at a much higher frequency, referred to here as a carrier frequency. When a single burst of pulses is supplied to the drop forming device 28 at a carrier frequency rate that exceeds the response rate of the drop forming device 28 (thermal response rate when the drop forming device is a heater or mechanical actuation response rate when it is a piezoelectric actuator or some other displacement actuator), then the drop forming device acts on the liquid jet as though the single burst of pulses were a single pulse, whose width is equal to the total width of the burst of pulses and whose power level is equal to the average power supplied by the burst of pulses, Referring to FIGS. 5A and 5B, a prior art large-drop waveform 106 having period $X_L=N\cdot X_S$ consists of an energy pulse 108 having energy $E_L$. The drop formation device 28, when supplied with a large drop waveform 106, produces a perturbation or disturbance on the filaments, commonly called jets, of liquid 52 having time period of $X_L$ and a corresponding spatial period of $\lambda_L$. As $X_L$ is approximately N times $X_S$, $\lambda_L$ is approximately N times $\lambda_S$. This perturbation grows causing a segment 110 of the jet 112 to break off to form an initial large drop 114; the initial large drop having a volume equal to that of a $\lambda_L$ long segment of the liquid jet. Because $X_L$ is not approximately the Rayleigh period but rather approximately N times the Rayleigh period, the $\lambda_L$ long segment of the jet tends to break up into more than one interim drop 116. These drops eventually merge into a coalesced large drop 118. The volume of the large drop (both initial and coalesced) is approximately N times the volume of the small drop produced by the waveform with period $X_S$. The distance from the nozzle plate 49 at which the drops coalesce to form the large drop is called the drop formation length (DFL). Short drop formation lengths DFL are preferred. The voltage or stimulation level applied during pulse 108 corresponds to a dc power level $P_L$, and the pulse energy $E_L$ for the pulse of width $w_L$ is $P_L\cdot w_L$.

Figure 6:
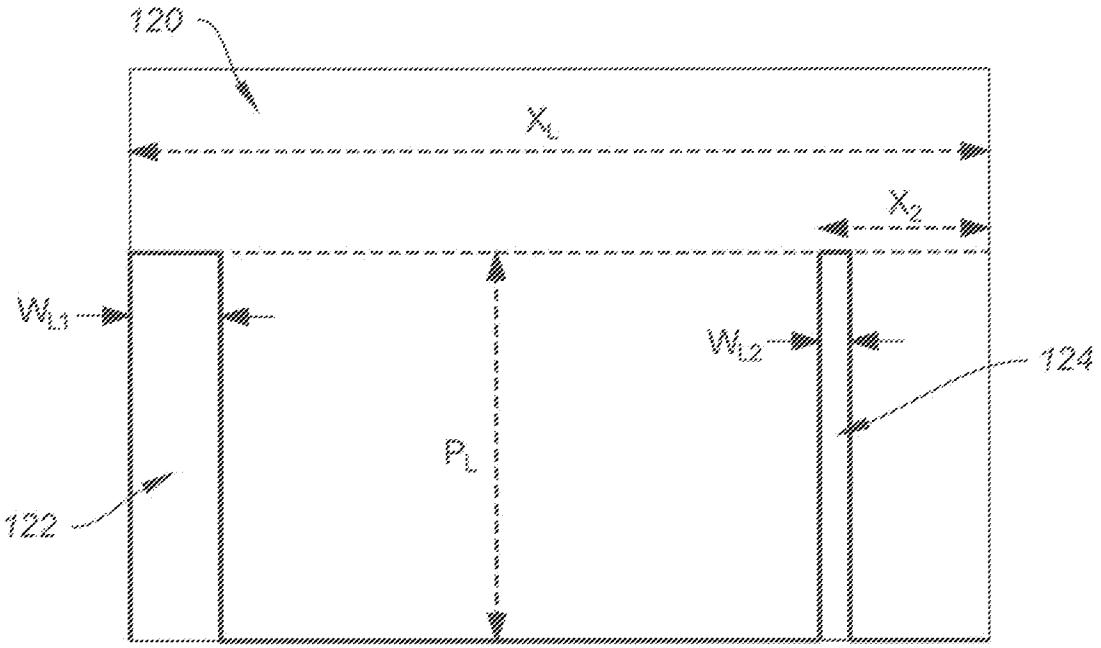
FIG. 6 is a schematic representation of a large drop waveform made in accordance with the present invention.

An embodiment of a large drop waveform 120 according to the invention is shown in FIG. 6. The large-drop waveform 120 has a period $X_L$ and begins with an energy pulse 122, as did the prior art waveform. In addition to the leading or first pulse 122, the waveform includes a second pulse 124. The first and second pulses having respective energies $E_{L1}$ and $E_{L2}$; where $E_{L1}>E_S$ and $E_{L2}<E_S$. The second pulse 124 is timed to be close to the end of the waveform, placing it close in time to the energy pulse at the start of the subsequent small drop or large drop waveform. The second pulse 124 occurs a time period $X_2$ prior to the initial pulse of a subsequent small- or large-drop waveform; where $X_2<X_S$, and more preferably $X_2<X_C$. The inclusion of this second pulse 124 shortly before the initial pulse of a subsequent small- or large-drop waveform aids in forming the large drop, reducing the drop formation length DFL. Keeping $X_2$ less than $X_S$, reduces the possibility of producing an additional drop during the waveform period as a result of the second pulse. Thus, it is important to have $X_2<X_S$. Preferably $X_2$ is in the range of $0.05X_S<X_2<0.9X_S$. More preferably $X_2<X_C$, where $X_C$ is the Rayleigh cutoff period for drop formation. Keeping $X_2<X_C$, further reduces the risk of creating a drop due to the second pulse as this timing ensures that the disturbances on the jet do not grow, but rather decay along the jet and so do not result in drop formation. It furthermore produces a significant reduction in the drop formation length. An even more preferred range for $X_2$ is between 0.25 and 0.7 times $X_S$. The voltage or stimulation level applied during pulses 122 and 124 having respective widths $w_{L1}$ and $w_{L2}$ corresponds to a dc power level $P_L$, and the pulse energy $E_S$ for the large drop formation waveform is $P_L\cdot(w_{L1}+w_{L2})$.

By experiment it is found that the first and second pulses 122 and 124 in the large-drop waveform of FIG. 6 have the combined effect of imparting significant differential velocity to the interim drops 116 that are formed within the waveform period at jet break-up. This differential velocity decreases the drop formation length DFL significantly relative to that obtained using the prior art large drop waveform shown in FIG. 5A. The drop formation length is reduced when the ratio of the energy of the second pulse $E_{L2}$ to the sum of the energies of the first and second pulses $E_{L1}+E_{L2}$ is in the range. $0.01(E_{L1}+E_{L2})<E_{L2}<0.4(E_{L1}+E_{L2})$. A more preferred range for reducing the drop formation length is $0.06(Eu_{L1}+E_{L2})<E_{L2}<0.3(E_{L1}+E_{L2})$, and an even more preferred range is $0.10(E_{L1}+E_{L2})<E_{L2}<0.25(E_{L1}+E_{L2})$.

Furthermore, it is found by experiment that the large-drop waveform of FIG. 6 provides adequate ability to reduce the distance over which small satellite drops, ejected at break-up, travel prior to merging with the main drop. This adjustment can be made with only minor impact on the drop formation length.

Finally, it is found by experiment that the large-drop waveform of FIG. 6 produces a reduced disturbance on neighboring jets. A particularly sensitive case is when a jet is producing several print drops, for example, large drops, while its neighbors are producing small drops. In particular, the transition between producing small drops (catch drops) and print drops can cause a significant disturbance on the neighboring jets, promoting the merger of the small drops and consequent failure to catch the merged small drops before they exit the print head. Using phase shifts of multiple half periods $X_S/2$ between odd and even jets, as is described in US Patent Application Publication No. US 2011/0109677 A1, published on May 12, 2011, in the name of Montz et al., the large drop waveform of FIG. 6 is found to have reduced disturbance (relative to prior art waveforms) on neighboring jets wherein catch drops are being produced.

Figure 7:
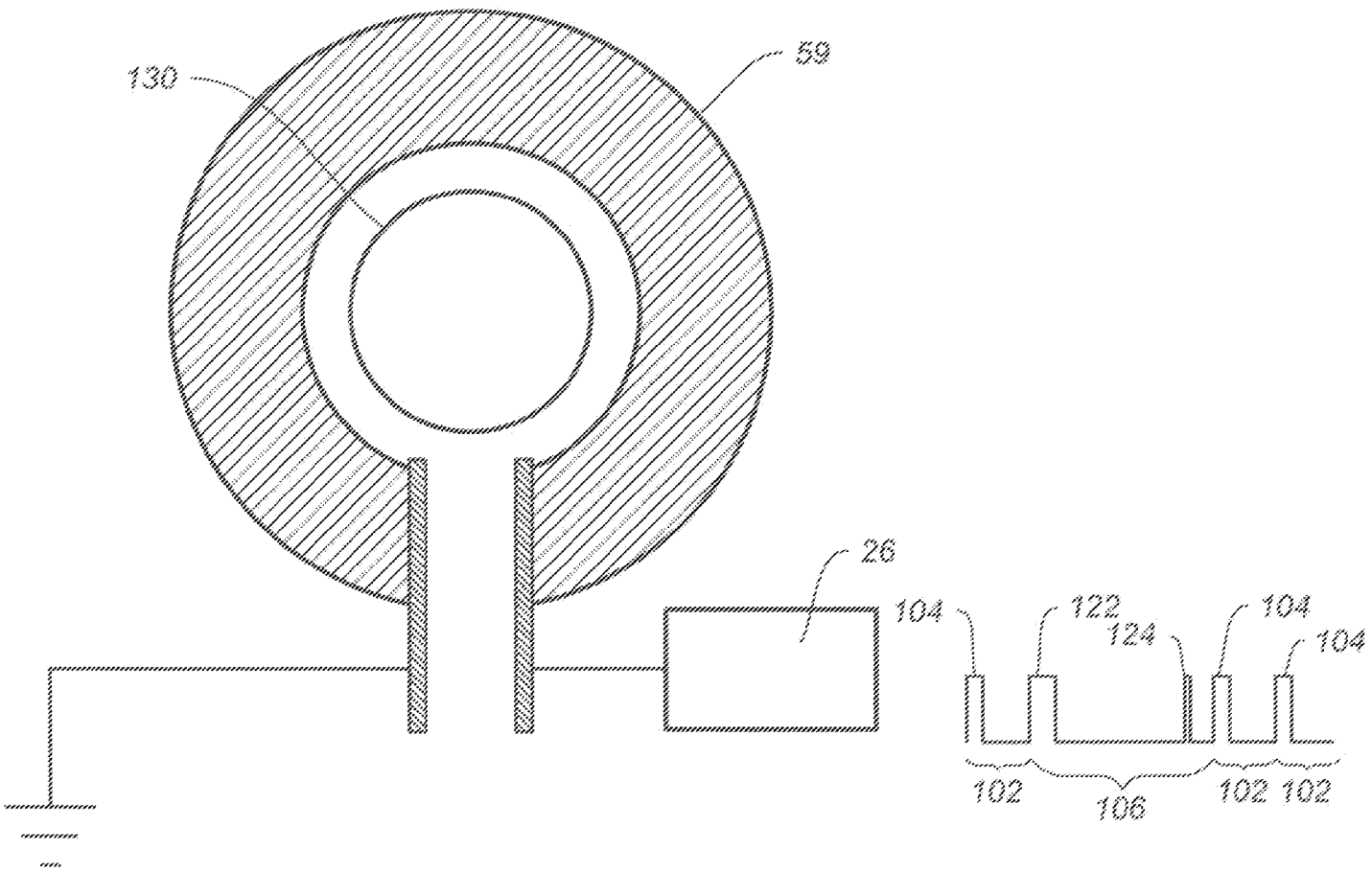
FIG. 7 is a schematic plan view of a portion of a nozzle plate including a nozzle with an associated drop formation device made in accordance with an example embodiment of the present invention.

FIG. 7 is a plan view of a portion of a nozzle plate 49 showing a nozzle 50 with an associated drop formation device 28 according to one embodiment of the invention. The drop forming device is a single drop forming transducer that substantially surrounds the nozzle. The drop forming transducer can be one of a heater, piezoelectric transducer, electrohydrodynamic stimulation device, thermal actuator or any other drop forming transducer. In response to a drop forming waveform supplied to the drop forming transducer, it acts on one of the nozzle, the liquid passing through the nozzle, or the liquid jet flowing from the nozzle to introduce a perturbation to the liquid jet such that the perturbation can grow to cause a drop to break off from the liquid jet. The drop forming transducer substantially surrounds the nozzle so that as it acts on the liquid passing through the nozzle and it doesn't substantially alter the directionality of the liquid jet.

Figure 8:
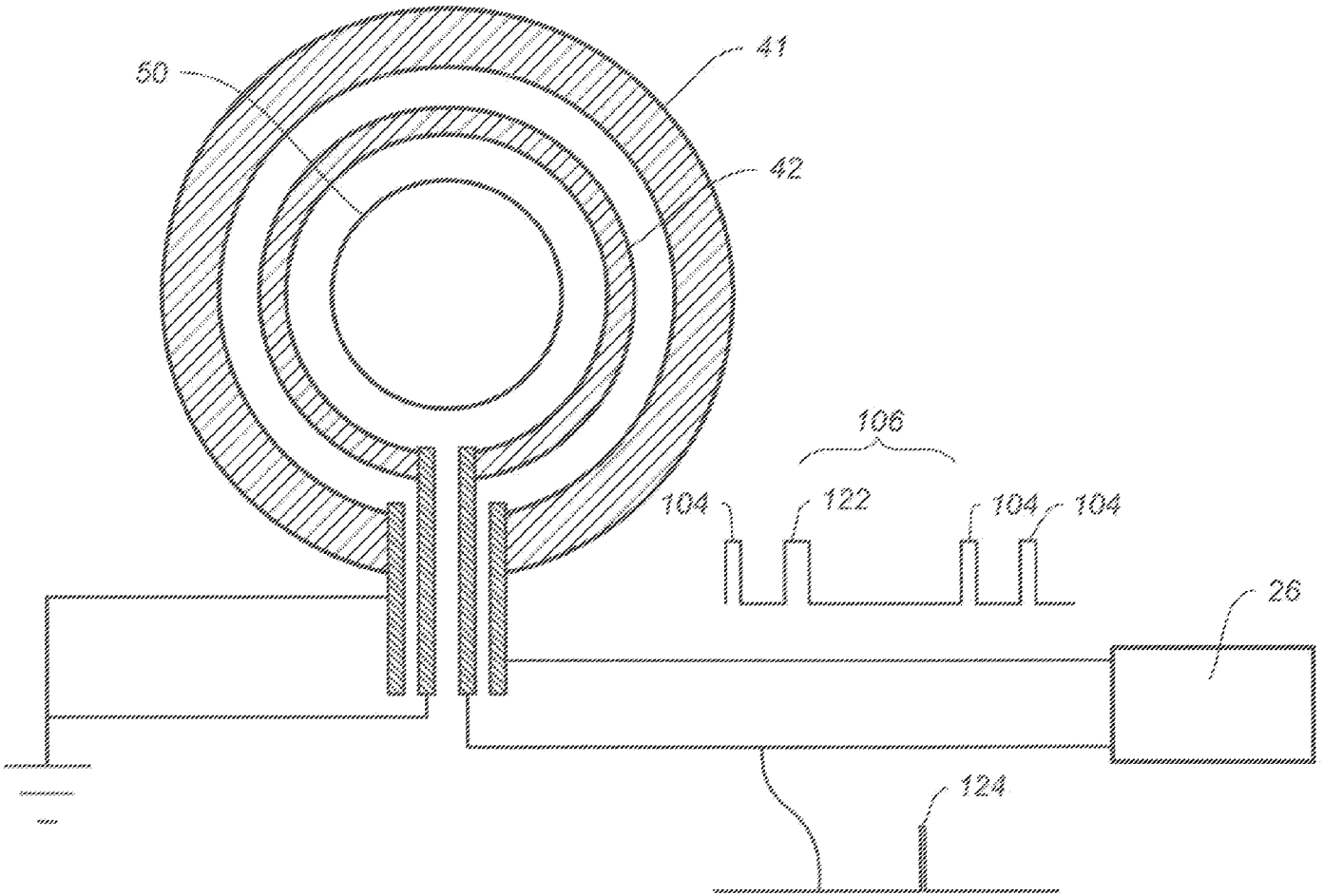
FIG. 8 is a schematic plan view of a portion of a nozzle plate including a nozzle with an associated drop formation device made in accordance with another example embodiment of the present invention.

FIG. 8 is a plan view of a portion of a nozzle plate 49 showing a nozzle 50 with an associated drop formation device 28 according to another embodiment of the invention. The drop forming mechanism includes a first drop forming transducer 41, and a second drop forming transducer 42. The drop forming transducers can each be one of a heater, a piezoelectric transducer, a MEMS actuator, an electrohydrodynamic stimulation device, thermal actuator, an optical device, or an electrostrictive device. Combinations of these types of drop forming mechanisms are also permitted. Alternatively, other types of conventional drop forming transducers of mechanisms can be used. Alternatively, the drop formation device can be associated with the liquid chamber or the liquid jet instead or in addition to the nozzle.

Each drop forming transducer acts on the nozzle, the liquid passing through the nozzle, or the liquid jet flowing from the nozzle to introduce a perturbation to the liquid jet such that the perturbation can grow to cause a drop to break off from the liquid jet. The drop forming transducers are each substantially symmetric about the nozzle 50 so that as to act on the liquid passing through the nozzle and not substantially alter the directionality of the liquid jet. In response to the print data, the mechanism control circuit 26 creates the drop formation waveforms and supplies them to the drop forming transducers. In the embodiment shown, the energy pulses of the small drop waveforms and the first pulse 122 of the large drop waveform are supplied to the first drop forming transducer 41.

The second pulse 124 of the large drop waveform 106 is supplied to the second drop forming transducer 42. In other embodiments, different distribution mixes of energy pulses can be supplied to the first and second drop forming transducers, such as energizing both the first and second drop forming transducers with one or both of the first and second pulses of the long drop formation waveform, while directing the energy pulses of the small drop waveform only to the first drop formation transducer.

The invention has been described in detail with particular reference to certain preferred embodiments thereof, but it will be understood that variations and modifications can be effected within the scope of the invention.

PARTS LIST

20 Continuous Printer System
22 Image Source
24 Image Processing Unit
26 Mechanism Control Circuits
27 Drop Formation Waveform
28 Device
30 Printhead
32 Recording Medium
34 Recording Medium Transport System
36 Recording Medium Transport Control System
38 Micro-Controller
40 Reservoir
42 Catcher
44 Recycling Unit
46 Pressure Regulator
47 Channel
48 Jetting Module
49 Nozzle Plate
50 Nozzle
51 Heater
52 Liquid
54 Drops
56 Drops
57 Trajectory
58 Drop Stream
60 Gas Flow Deflection Mechanism
61 Positive Pressure Gas Flow Structure
62 Gas Flow
63 Negative Pressure Gas Flow Structure
64 Deflection Zone
66 Small Drop Trajectory
68 Large Drop Trajectory
72 First Gas Flow Duct
74 Lower Wall
76 Upper Wall
78 Second Gas Flow Duct
82 Upper Wall
84 Seal
86 Liquid Return Duct
88 Plate
90 Front Face
92 Positive Pressure Source
94 Negative Pressure Source
96 Wall
100 Drop Formation Waveform
102 Small Drop Waveform
104 Energy Pulse
106 Large Drop Waveform
108 Energy Pulse
110 Segment
112 Jet
114 Initial Large Drop
116 Interim Drops
118 Coalesced Large Drop
122 First Pulse
124 Second Pulse
134 First Drop Forming Transducer
136 Second Drop Forming Transducer
138 Waveform Source
140 Second Waveform Source

The invention claimed is:

1. A method of operating a jetting module comprising:
providing a jetting module including a nozzle and a drop forming mechanism;
providing a liquid to the jetting module under pressure sufficient to cause a liquid stream to jet from the nozzle;
providing a small drop waveform that causes the liquid stream to break up into a small volume drop, the small drop waveform including a pulse having a width $w_S$, the small drop waveform having a period x, where $x \approx 1/f_R$, and where $f_R$ is the Rayleigh frequency of the liquid;
providing a large drop waveform that causes the liquid stream to break up to form a large volume drop, the large drop waveform having a period Nx, the large volume drop being N times the volume of the small volume drop, the large drop waveform including a first pulse having a pulse width $w_{L1}$, where $w_{L1} \geq w_S$, the large drop waveform including a second pulse occurring within a period of $(f_R/f_C)x$ of an initial pulse of a subsequent small drop waveform or a subsequent large drop waveform, where $f_C$ is the cut off frequency of the liquid, the second pulse having a pulse width $w_{L2}$, where $w_{L2} < w_S$; and
activating the drop forming mechanism using a sequence of small drop waveforms, the large drop waveforms, or combinations thereof.

2. The method of claim 1, wherein the drop forming mechanism comprises:
a first drop forming transducer; and
a second drop forming transducer.

3. The method of claim 2, wherein activating the drop forming mechanism comprises:
providing the first pulse of the large drop waveform to the first drop forming transducer; and
providing second pulse of the large drop waveform to the second drop forming transducer.

4. The method of claim 1, further comprising:
providing a catcher;
providing a deflection mechanism;
deflecting one of the large volume drop and the small volume drop using the deflection mechanism;
collecting one of the large volume drop and the small volume drop using the catcher.

5. The method of claim 1, wherein the drop formation device is associated with one of the liquid chamber, the nozzle, and the liquid jet.

6. The method of claim 5, wherein the drop formation device is one of a thermal device, a piezoelectric device, a MEMS actuator, and an electrohydrodynamic device, an optical device, an electrostrictive device, and combinations thereof.

* * * * *